US005473855A

United States Patent [19]

Hidding et al.

[11] Patent Number: 5,473,855

[45] Date of Patent: Dec. 12, 1995

[54] SYSTEM FOR INSTALLING CLOSURES ON CONTAINERS

[76] Inventors: Walter E. Hidding, 367 A Woodrock Rd., Barrington Hills; Douglas J. Hidding, 801 E. Lake Shore Dr., Barrington, both of Ill. 60010; Robert D. Hidding, 925 Harper Dr., Algonquin, Ill. 60102; H. Thomas Boyles, 336 Ridgewood, Glen Ellyn, Ill. 60137

[21] Appl. No.: 287,821

[22] Filed: Aug. 9, 1994

[51] Int. Cl.[6] ..... B67B 3/20; B65B 7/28

[52] U.S. Cl. ..... 53/314; 53/317; 53/331.5

[58] Field of Search ..... 53/306, 313, 314, 53/317, 331.5

[56] References Cited

U.S. PATENT DOCUMENTS

| | | | |
|---|---|---|---|
| 2,033,358 | 3/1936 | Risser | 53/306 X |
| 2,359,932 | 10/1944 | Newey | 53/306 X |
| 3,073,090 | 1/1963 | Roberts et al. | 53/331.5 |
| 3,309,838 | 3/1967 | Wilhere | 53/306 X |
| 3,491,516 | 1/1970 | Bergeron | 53/331.5 X |
| 3,771,284 | 11/1973 | Boeckmann et al. | 53/331.5 X |
| 3,908,341 | 9/1975 | Conti | 53/331.5 X |
| 4,089,153 | 5/1978 | Long | 53/331.5 |
| 4,765,119 | 8/1988 | Aidlin et al. | 53/317 X |
| 5,012,630 | 5/1991 | Ingram et al. | 53/331.5 X |
| 5,398,485 | 3/1995 | Osifchin | 53/331.5 X |

*Primary Examiner*—Horace M. Culver
*Attorney, Agent, or Firm*—David I. Roche

[57] ABSTRACT

A system for securely placing threaded caps on threaded containers. The system includes a cap feeding device which facilitates the initial placement of caps on container necks. After initial placement, the cap and container are brought into engagement with a spindle assembly which grips the cap and prevents rotation of the container. The spindle assembly engages a is brought into contact with a rotation inducing device, which causes the tightening of the cap onto the container neck. The chuck of the spindle assembly and the rotation inducing device each have the ability to prevent overtightening of the cap onto the container. In addition, the cap and container are specially configured to facilitate initial placement in a manner which reduces the possibility of misalignment.

31 Claims, 12 Drawing Sheets

Fig. 15
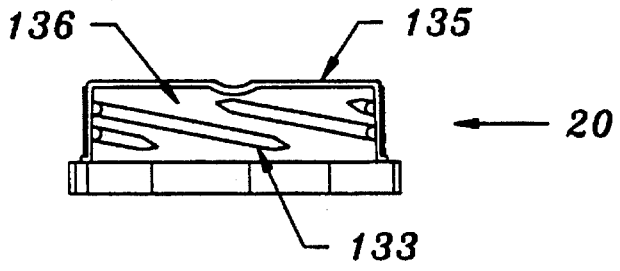
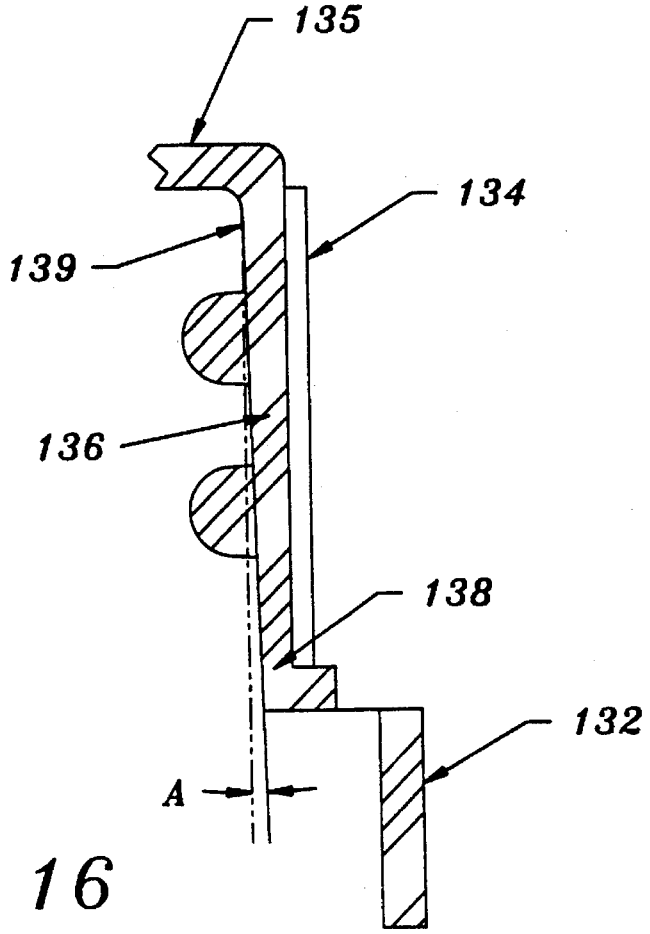
Fig. 16

Fig. 17
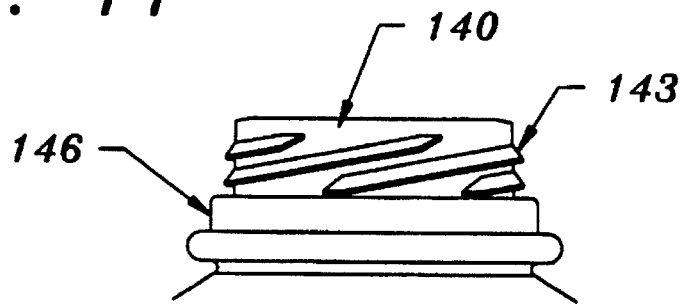
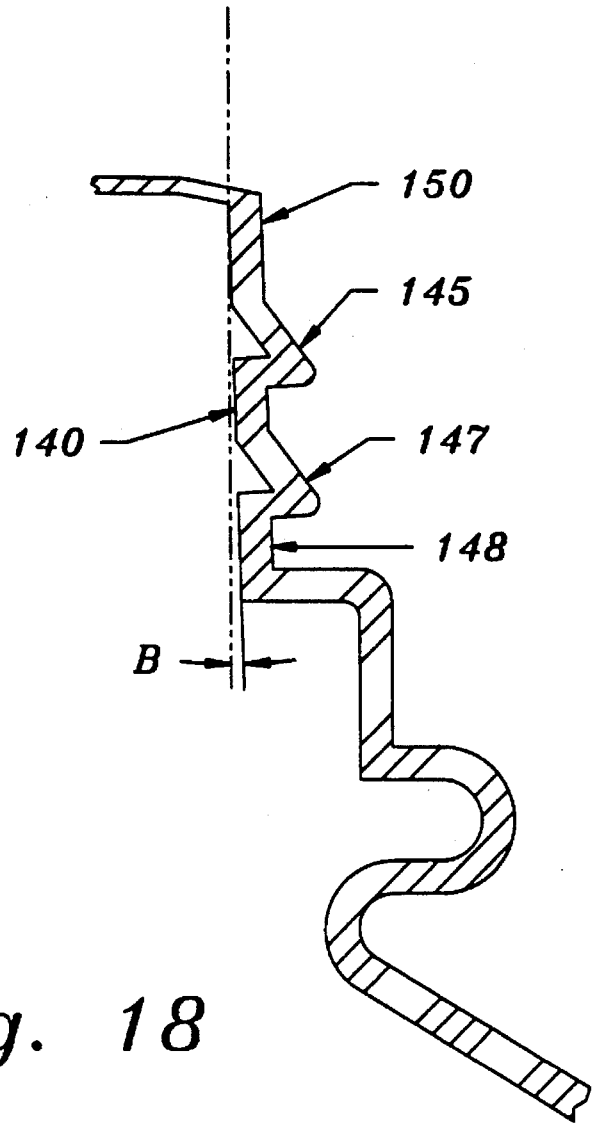
Fig. 18

SYSTEM FOR INSTALLING CLOSURES ON CONTAINERS

BACKGROUND AND SUMMARY OF THE INVENTION

Machines for applying closures to containers are well known and widely used. The present invention relates to the application of threaded closures to containers having threaded necks, and is particularly directed to the application of closures to containers which hold consumable liquids.

One of the major difficulties with most currently used equipment, closures and containers, is the need to thoroughly and frequently clean the equipment so that the contents of the containers is not contaminated. In addition, problems associated with so-called "cocked" or misaligned threads on the closure and container neck are also prevalent. Further, operators of bottling facilities also experience difficulty resulting from crushed containers resulting from the application of excessive downward forces in the capping operation. Overtightening or stripping of the threaded connection between the closure and the container is also a problem and, depending upon the lubricity of the liquid being placed in the container, stripping can be a significant problem.

Many bottlers, for convenience and to reduce costs associated with shipment of empty containers, blow mold containers on-site. Because many bottlers do not have expertise in blow molding operations and, in particular, tooling maintenance, serious problems can arise, such as bottles being molded to configurations which significantly vary over time. In some instances, bottlers have other difficulties relating to the quality of their bottles, such as excessive flash, mismatching of mold components, excessive parison pleating, and non-round openings. While caps are generally molded to relatively precise and consistent dimensions, blow molded bottles generally are not, particularly bottles made on-site by bottlers. To provide a reliable closure on bottles of varying dimensions and quality is a difficult challenge for cap suppliers.

The system of the present invention includes a capping apparatus with a simplified spindle assembly which may be easily cleaned. Turning of the spindle assembly is accomplished by causing its upper end to engage with a magnetically controlled rotation inducing gear segment or rack. The invention includes a variety of alternative devices for holding or gripping a cap and transferring rotative forces from the spindle to the cap. For example, a resilient ring or disk may be used to grip the cap by its splines or knurls and releasably turn the cap into engagement with the container neck. Alternatively, a chuck with opposing spring loaded jaws may be used.

The spindle assembly of the present invention has particular application in turret-type capping equipment of the general type shown and described in U.S. Pat. No. 3,771,284, but the spindle assembly and related rotation inducing equipment could be used in other types of machinery. When used with turret-type machinery, the feeder assembly of the present invention is used to bring a cap into initial proximity to a moving container neck. A conveyer brings the container into engagement with the cap and delivers the container to a turret. The container support of the turret holds the container in vertical alignment with a spindle assembly. When the container support engages a cam, rotation of the turret causes the container to be lifted into engagement with the spindle assembly. The spindle assembly has a chuck carried by the lower portion of the spindle, which grips the cap.

When the turret rotates, the spindle assembly comes into engagement with a rotation inducing surface which causes the spindle and the cap to rotate for a predetermined rotational extent. The cap gripping portion of the spindle assembly is designed to prevent overtightening of the cap onto the container. In one embodiment of the present invention, resilient fingers are carried by a ring held within the lower portion of the spindle assembly. If the cap tightens before the spindle assembly stops rotating, the resilient fingers allow the ring to continue rotating while the cap has stopped rotating. In an alternative embodiment, a cap gripping chuck with spring loaded jaws releasably grip the cap when the container is lifted into engagement with the spindle assembly. Again, if the cap tightens onto the container neck before the spindle disengages from the rotation inducing surface, the spring loaded jaws slip past the splines on the cap to prevent stripping of the cap.

To further prevent overtightening of the cap onto the container, the rotation inducing gear segment or rack is releasably held in place by a magnet. When a predetermined force is applied laterally to the gear segment or rack, the retaining force of the magnet is exceeded and the gear segment or rack is free to pivot, thereby preventing further rotative forces from being applied to the cap.

It should be also be noted that the caps and container necks of the present invention are specifically designed to facilitate the placement and tightening operations of the apparatus of the present invention. In particular, the cap of the present invention includes a skirt with a generally conical or tapering inside surface. In a preferred embodiment, the thickness of the skirt varies so that the inside diameter of the skirt is larger at the lower end as compared to the inside diameter of the skirt at its upper end. Similarly, the outside surface of the vertical portion of the threaded neck of the container is tapered such that the outside diameter of the neck at the uppermost portion is less than the outside diameter of the neck at the lower portion of the neck. The matching conical configuration of the inside of the cap and the container neck facilitate the initial placement of the caps on the container neck. Thus, the incidence of misalignment (or "cocking") of the threads on the cap and container neck is reduced substantially. This improved or increased interfitting tolerance of the cap onto the bottle neck over overcomes some of the difficulties resulting from "out-of-tolerance" blow molded bottles.

These and other objects and advantages of the present invention will be better understood upon a reading of the following specification read in conjunction with the accompanying drawings.

BRIEF DESCRIPTION OF THE DRAWINGS

FIG. 15 is a sectional view of a cap made in accordance with the present invention;

FIG. 16 is an enlarged sectional view of the skirt of the cap of the present invention;

FIG. 17 is an elevational view of a container neck made in accordance with the present invention; and FIG. 18 is an enlarged sectional view of the container neck shown in FIG. 17.

DETAILED DESCRIPTION OF THE INVENTION

Figure 1:
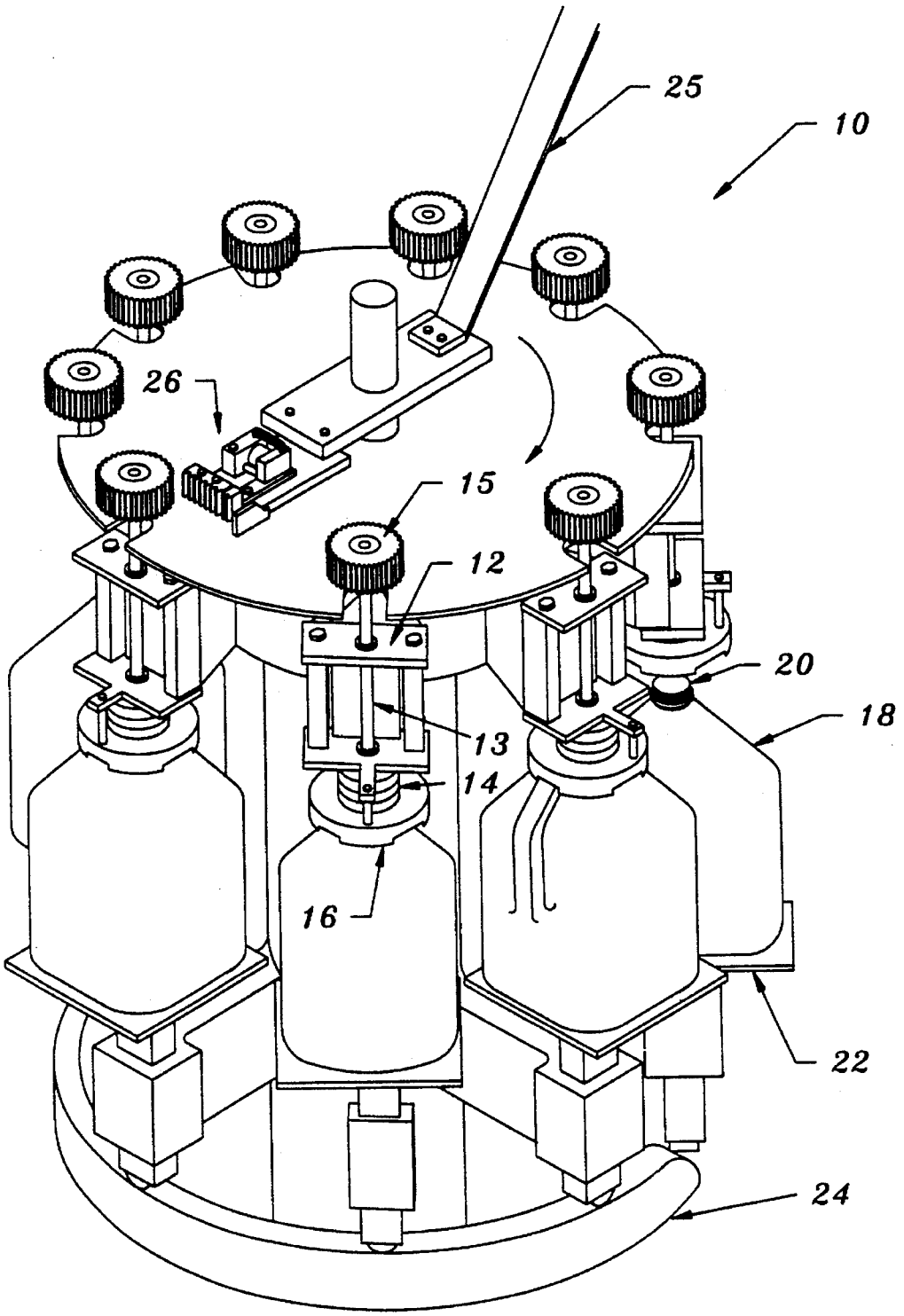
FIG. 1 is a perspective view of a turret with spindle assemblies in accordance with the present invention.

FIG. 1 shows a turret assembly 10 with nine stations. Each turret station includes a spindle assembly 12 held in place by a spindle support 11. Plates 42 and 43 hold and guide a spindle shaft 13. A drive gear or pinion 15 is disposed at the upper end of the spindle shaft 13, and a chuck 14 is disposed at the lower end of the spindle shaft 13. Attached to the lower end of the spindle support 11 is a chuck 14 with a bottle holder 16 inside which transfers rotative forces to the bottle 18 as the cap 20 is tightened onto the bottle 18.

As the turret 10 rotates in the direction of the arrow shown in FIG. 1, the bottle supports 22 engage a cam 24, and lift each bottle 18 upward and cause the cap 20 to engage the bottle holder 16 inside the chuck 14. The turret 10 brings the spindle assemblies 12 into periodic engagement with the tightening assembly 26. The tightening assembly 26 is shown in detail in FIG. 2.

The tightening or rotation inducing assembly 26 includes a starter 34 comprised of a first gear segment 33 with two tapered or truncated gear teeth 35 and 37. A second gear segment or rack 36 with fully formed gear teeth 39 is mounted to a pivoting plate 45. The second gear segment or rack 36 has teeth shaped to mesh with the gear 15 carried by the spindle assembly 12. The gear 15 is preferably made of a hard rubber material. The plate 45 is held in place by a magnet 30, which prevents rotation of the plate 45 about the bolt 28, until a predetermined excessive force is applied laterally to the gear segment 36. When lateral forces exerted by the gear 15 upon the second segment 36 are in excess of the force exerted by the magnet 30 on the plate 45, the plate 45 will disengage from the magnet 30 and the second gear segment 36 will stop exerting a rotative force on the gear 15. After the gear 15 and its associated spindle assembly 12 have passed the tightening assembly 26, the spring 32 will then bring the plate 45 back into engagement with the magnet 30. The adjustment bolt 38 may be used to adjust the distance between the magnet 30 and the plate 45 in order to adjust the amount of force required to cause the plate 45 to pivot about the bolt 28.

Figure 2:
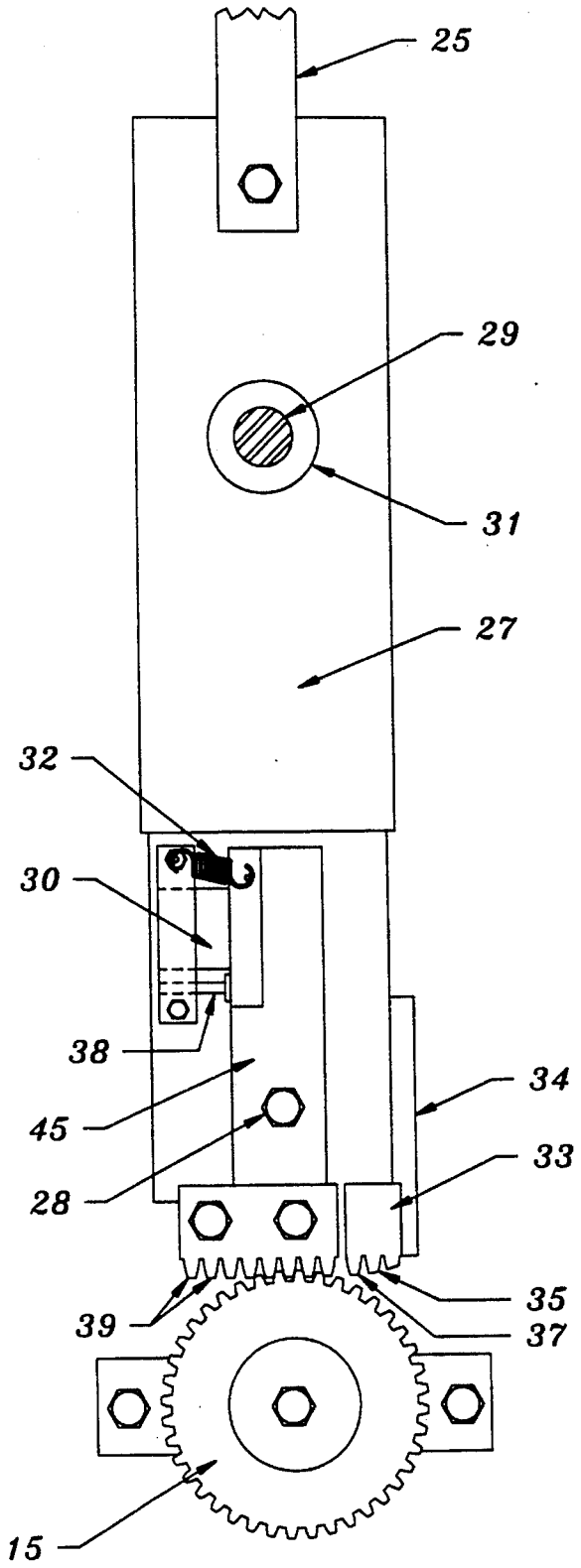
FIG. 2 is a plan view of the rotation inducing or cap tightening assembly of the present invention.

The tightening assembly 26 shown in FIGS. 1 and 2 does not rotate with the turret 10. Rather, the main support plate 27 of the tightening assembly 26 is supported by a central shaft to which the turret 10 is mounted. In addition, the main support plate 27 is supported by a bar 25, which prevents the plate 27 from rotating. A rubber bushing 31 separates the main support plate 27 of the tightening assembly 26. The bushing 31 absorbs any inadvertently applied concentrated loads which may result from misalignment between the teeth on the gear 15 and the truncated gear teeth 35 and 37 on the first gear segment 33, or between the teeth on the gear segment or rack 36. It should be noted that, depending upon 1) the frictional characteristics of the material comprising the pinion 15 and the rack 36, and 2) the forces needed to tighten a cap onto a bottle, there may not be a need to have meshing teeth on the pinion and rack or either of them.

Figure 3:
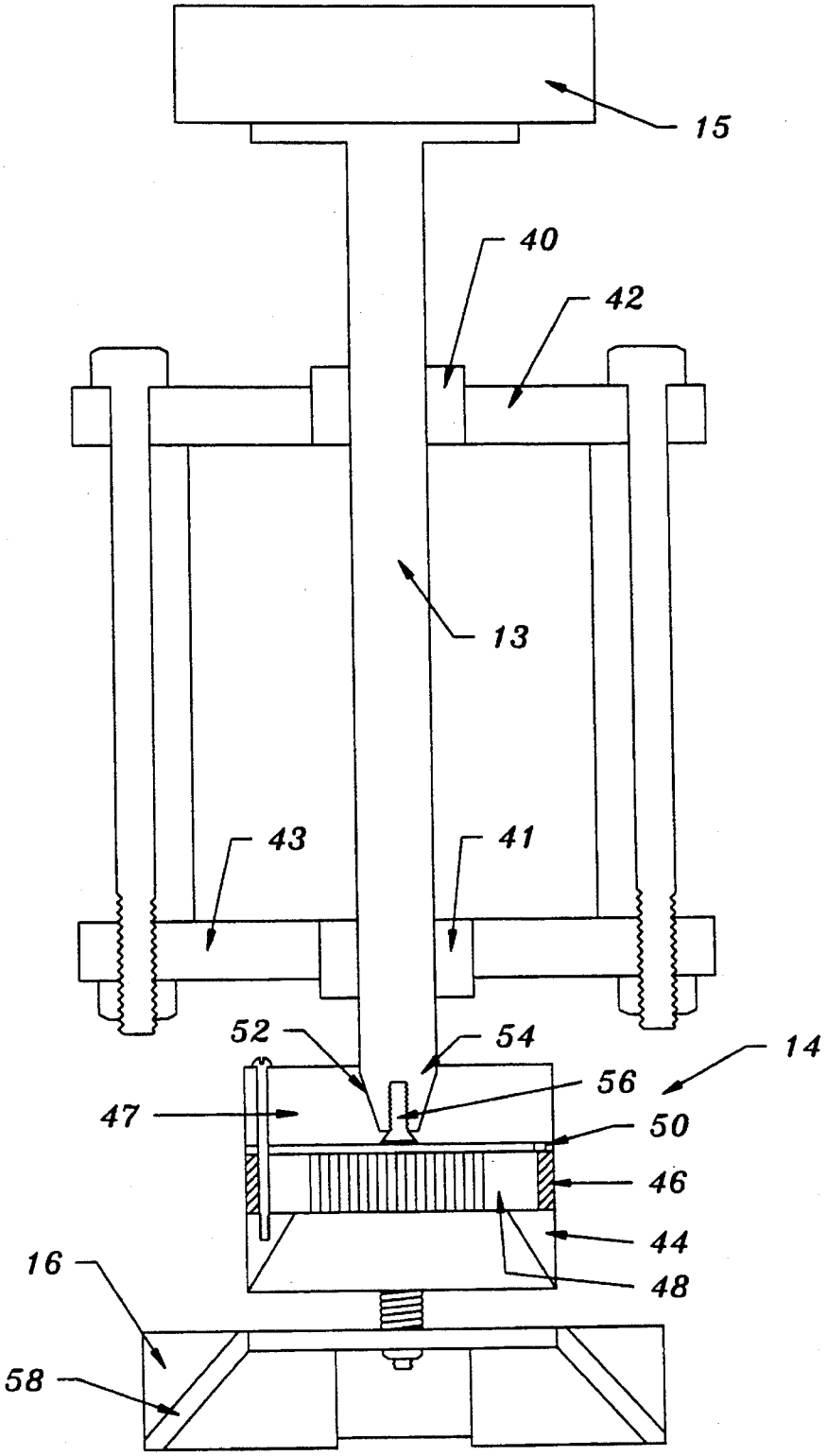
FIG. 3 is a front elevational view of the spindle assembly of the present invention.
Figure 4:
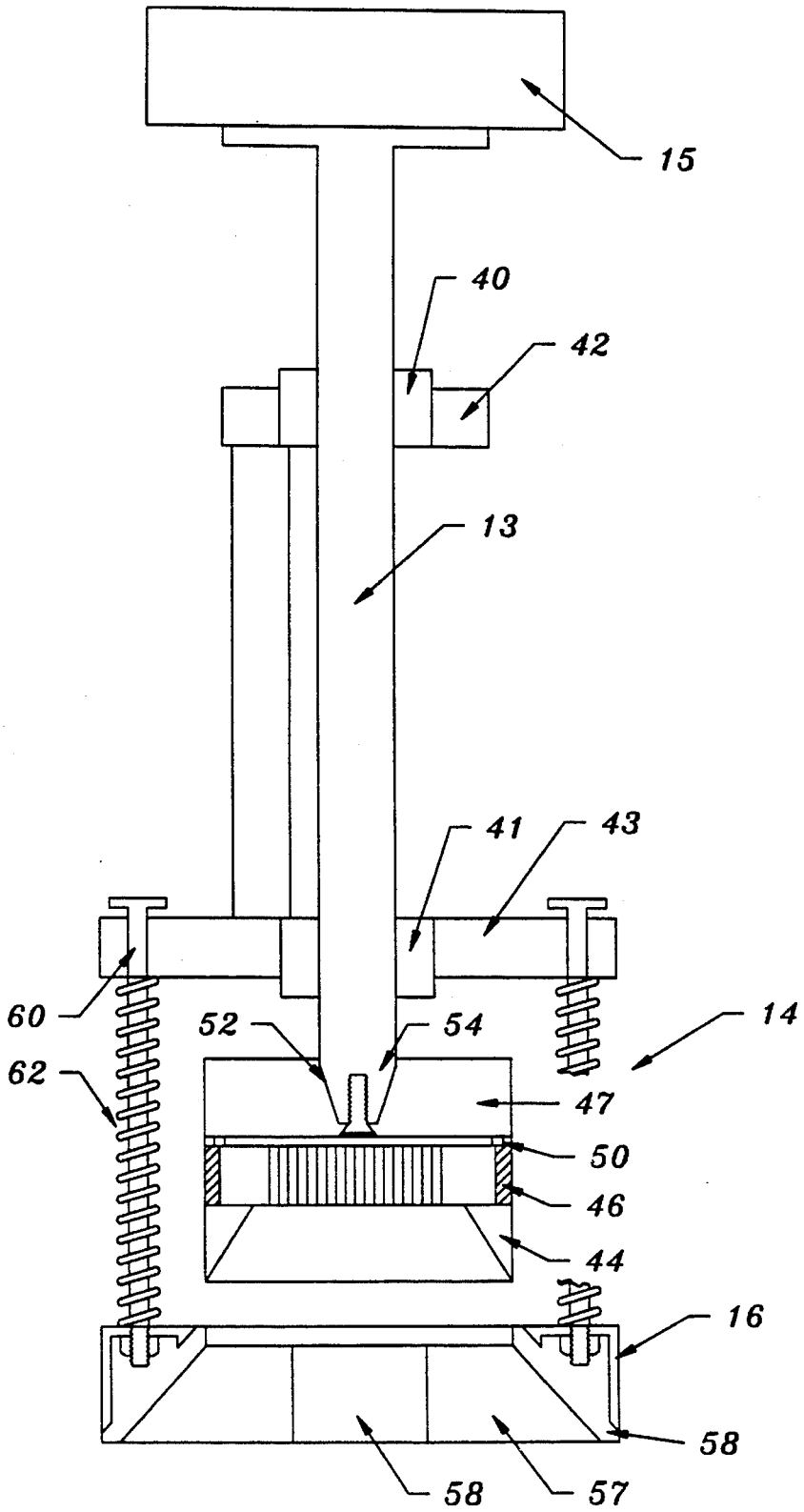
FIG. 4 is a side elevational view of a spindle assembly of the present invention.

FIGS. 3 and 4 show the details of the spindle assembly 12. The main support plates 42 and 43 of the spindle support 11 carry bearings 40 and 41, respectively. The spindle shaft 13 extends through the bearings 40 and 41 in a freely rotatable manner. A chuck 14 is carried by the lower end of the spindle 13. The chuck 14 is comprised of a conical guide 44, which ensures that a bottle cap and container 18 which is lifted into engagement with the chuck 14 will properly align with the grip 46. The grip 46 is shown in more detail in FIGS. 8 and 9. An upper chuck plate 47 is fastened to the lower end of the spindle 13 by a fastener 56. The upper chuck plate 47 has a conical recess 52 shaped to match the conical end 54 of the spindle 13. To facilitate quick and thorough cleaning of the grip 46, it includes spacers 50 which create a gap between the upper surface of the grip 46 and the lower surface of the upper chuck plate 47. The teeth 48 on the grip 46 are shown in more detail in FIG. 9. The bottle holder 16 is connected to the lower spindle support plate 43 by a pair of elongated bolts 60. Coil springs 62 wrap around the bolts 60 and urge the holder 16 away from the plate 43. This allows the bottle holder 16 to move vertically in a resilient fashion as the containers 18 are lifted into engagement with the spindle assembly 12. The bottle holder 16 is equipped with a conical undersurface 57 into which are cut four slots 58 which engage the handle of the bottles to prevent rotation of the bottle 18 as the caps are turned by the spindle assemblies 12. The bottle holder 16 has a central opening through which the chuck 14 is capable of extending. The pinion 15 is fixed to the uppermost end of the spindle shaft 13 so that rotative forces applied to the pinion 15 are transferred through the shaft 13 to the chuck 14, and ultimately to the cap 20 by the grip 46.

Figure 7:
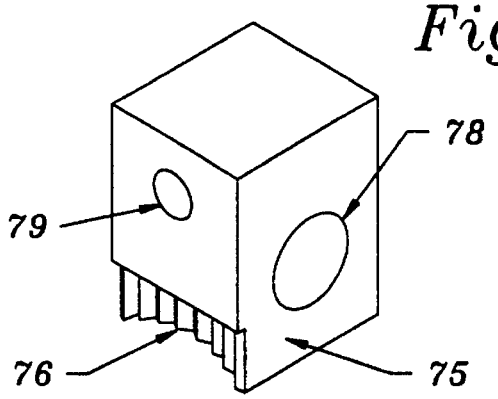
FIG. 7 is a perspective view of a jaw used in connection with the chuck shown in FIGS. 5 and 6.
Figure 6:
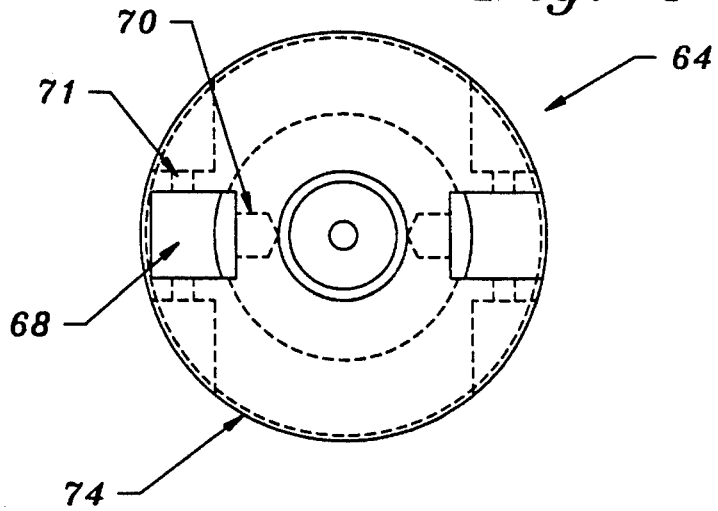
FIG. 6 is a top plan view of the chuck shown in FIG. 5.
Figure 5:
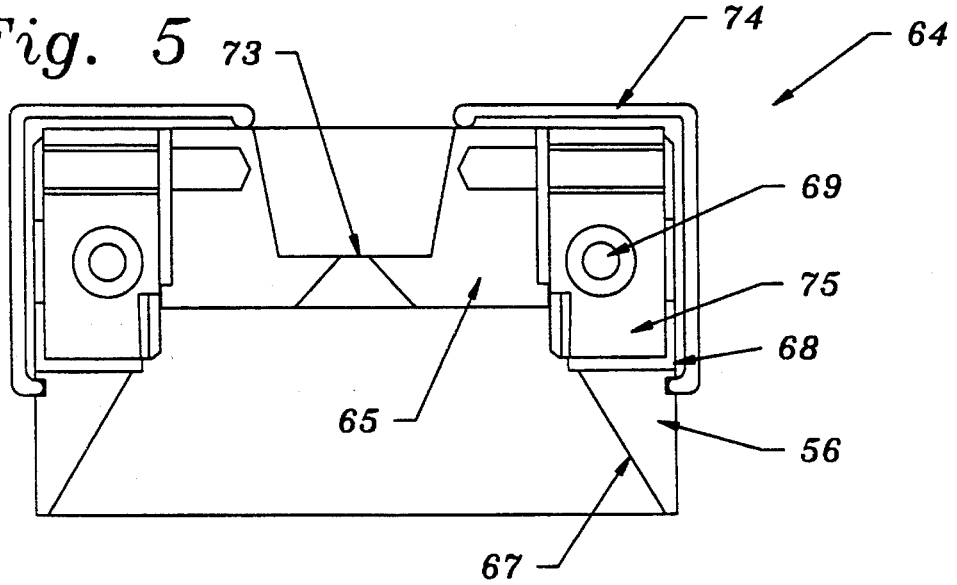
FIG. 5 is an enlarged sectional view of a chuck used to grip a cap of the present invention.

FIGS. 5, 6 and 7 show an alternative chuck assembly 64. The chuck assembly 64 includes a chuck body 65 with a lower end 56 having a conical guide surface 67. The chuck body 65 includes mounting slots 68 which receive a pair of opposing jaws 75. The jaws 75 are mounted to the chuck body 65 by pivot pins 69 which extend through openings 71 in the chuck body 65 and through openings 78 in the jaws 75. Coil springs (not shown) extend from the bores 70 in the chuck body 65 into the openings 79 in the jaws 75. As the jaws 75 pivot around the pivot pins 69, which extend through the opening 78 in the jaws 75, the teeth 76 at the base of the jaws 75 engage knurls on the cap as the cap and container 18 are lifted into engagement with the chuck assembly 64. The chuck assembly 64 is mounted to the conical end 54 of the spindle shaft 13 in a manner substantially identical to the manner in which the upper chuck plate 47 is mounted. A threaded fastener extends through the opening 73 and holds the chuck assembly 64 firmly to the lower end of the spindle shaft 13. A clip-on cover 74 encloses the upper part of the chuck assembly 64 and covers the jaws 75 and the slots 68.

Figure 9:
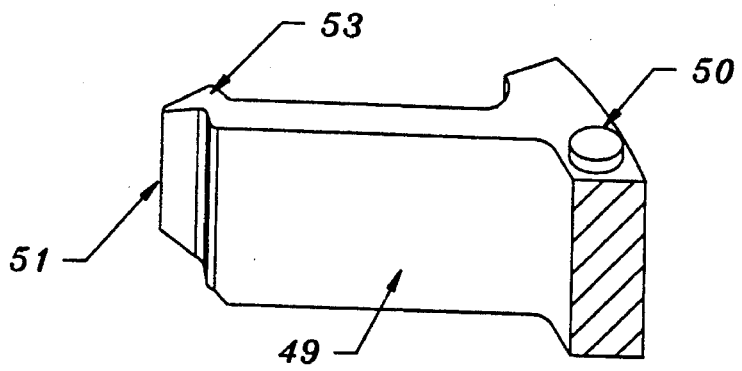
FIG. 9 is a perspective view in partial section of the fingers which form a part of the ring shown in FIG. 8.
Figure 8:
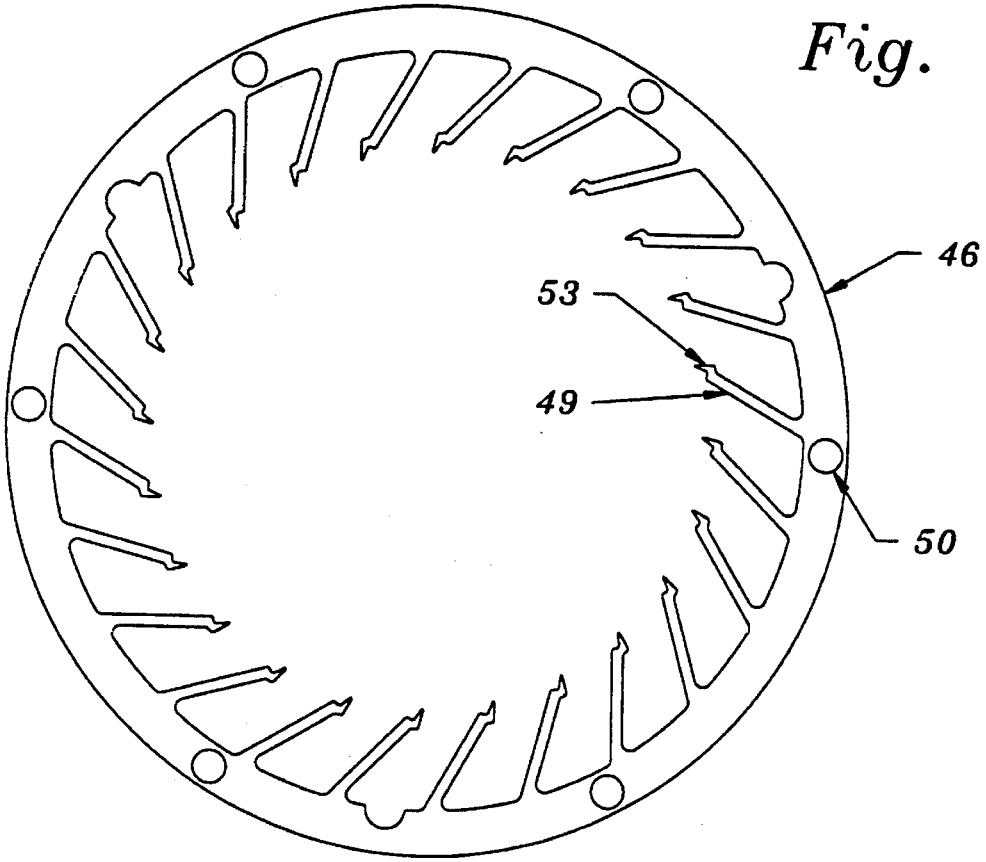
FIG. 8 is a top plan view of a ring used to grip the caps.

FIGS. 8 and 9 show in more detail the features of the grip 46. Inwardly directed fingers 49 are evenly spaced around the inside surface of the ring comprising the grip 46. Each finger 49 has a tip 53 with an inner edge 51 which is shaped to fit between the knurls on the outside surface of the cap 20. In the embodiment shown in FIGS. 8 and 9, five knurls on the outside surface of the skirt 136 of the cap 20 fit between each vertically oriented edge 51 to facilitate insertion of the cap 20 into engagement with the fingers 49, the lower portion of the tip of each finger 49 is beveled. As discussed with reference to FIG. 3 above, the spacers 50 facilitate the cleaning of the grip 46 by allowing a high speed water jet or steam to be sprayed through a gap formed between the grip 46 and the upper plate 47.

Figure 12:
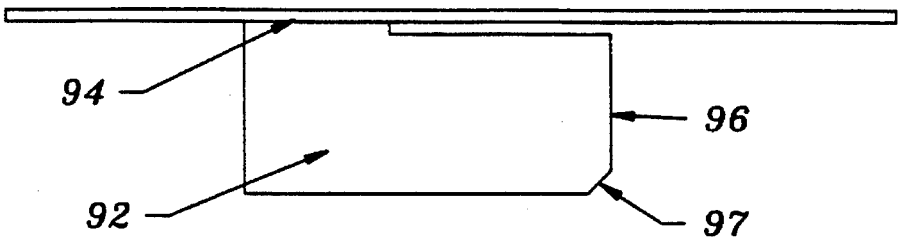
FIG. 12 is a sectional view showing a spring finger of the cap gripping device shown in FIG. 11.
Figure 11:
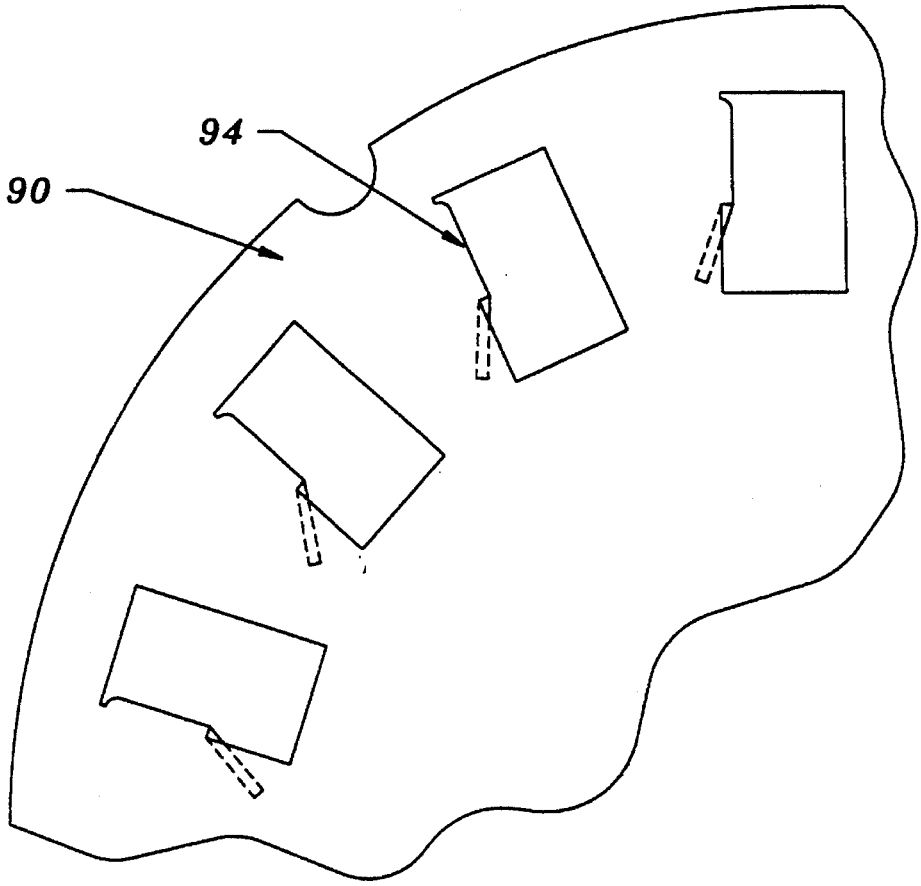
FIG. 11 is a plan view of an alternative cap gripping device.

FIGS. 11 and 12 show an alternative means for gripping a cap 20 in accordance with the present invention., A disk 90 has a series of fingers 92 which are bent downwardly and angled such that inner edges 96 of the fingers 92 are able to grip the cap 20 in a manner similar to the fingers 49 of the embodiment shown in FIGS. 8 and 9. The lower inside edges of the fingers 92 are beveled to facilitate the insertion of the cap into engagement with the disk 90. The fingers 92 remain connected to the body of the disk by a connecting section 94. Since the embodiment shown in FIGS. 11 and 12 is preferably made of a stamped metal, the disk 90 can be formed with spacing bumps 98 which serve the same purpose as the spacers 50 shown in FIGS. 3, 8 and 9, i.e. the bumps 98 facilitate cleaning of the disk 90.

Figure 10:
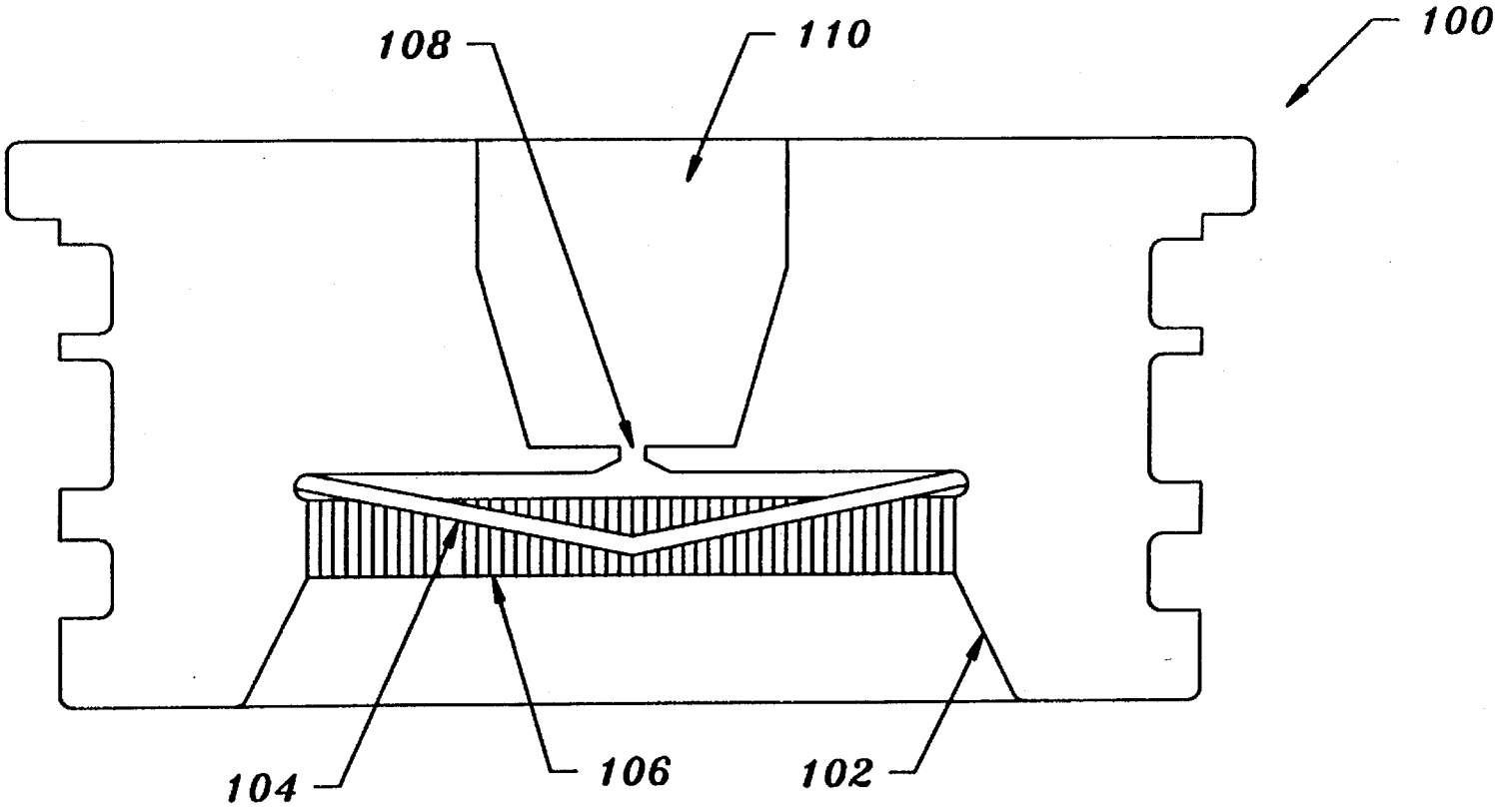
FIG. 10 is a sectional view of an alternative chuck.

FIG. 10 shows yet another embodiment of a chuck for use in practicing the present invention. The machined metal chuck 100 shown in FIG. 10 includes a conical guide surface 102 which leads or guides the cap into engagement with splines 106. Each spline 106 has a beveled lower edge to further facilitate the insertion of a cap into engagement with the chuck 100. Once tightening of the cap 20 on the container 18 has been completed, the leaf-spring 104 facilitates the removal of the cap from engagement with the chuck 100. The chuck 100 is attached to the lower end of the spindle by a fastener which extends through an opening 108. The conical recess 110 receives the lower end of the spindle shaft 13.

Figure 13:
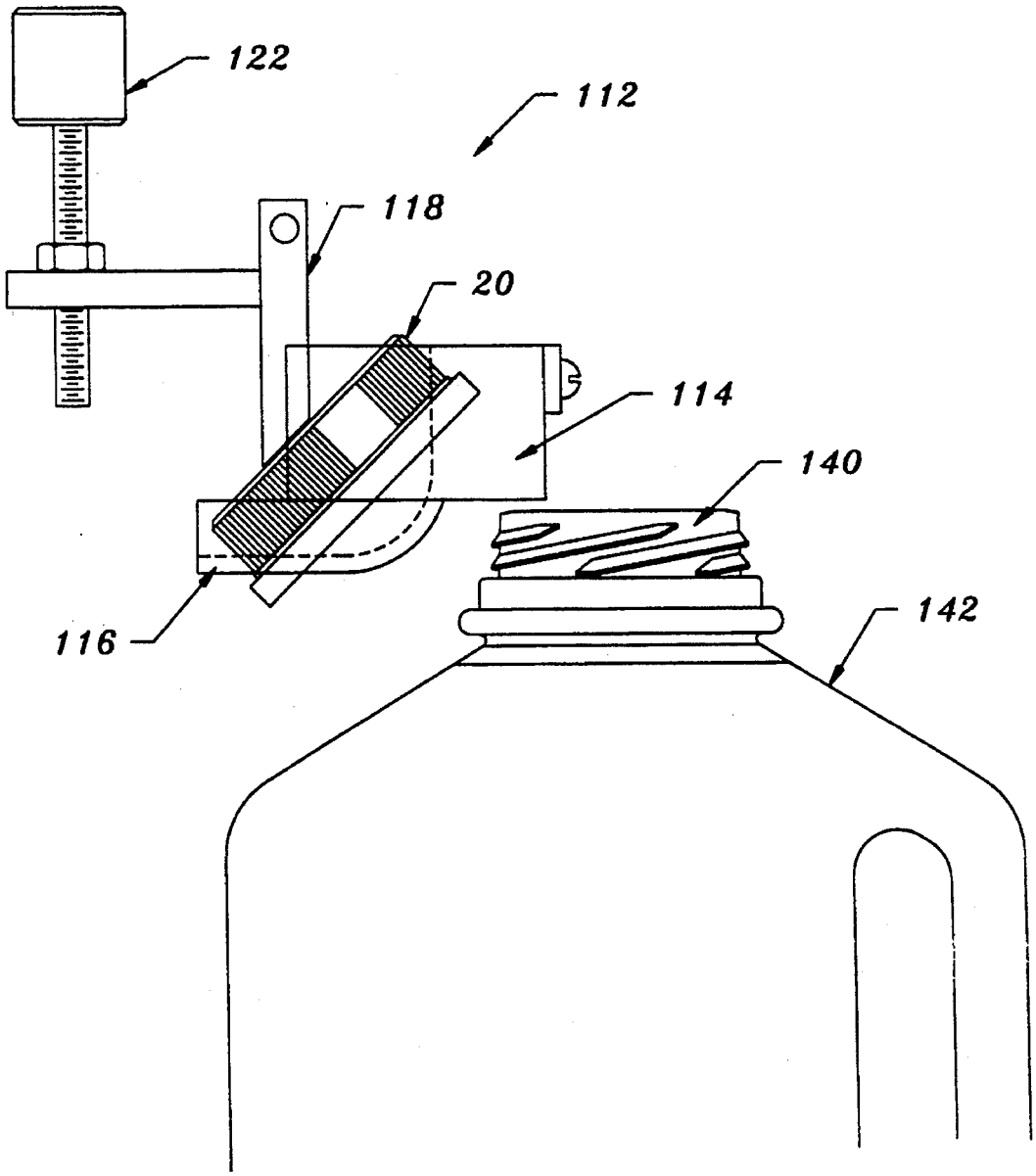
FIG. 13 is a side-elevational view of the feeder assembly.
Figure 14:
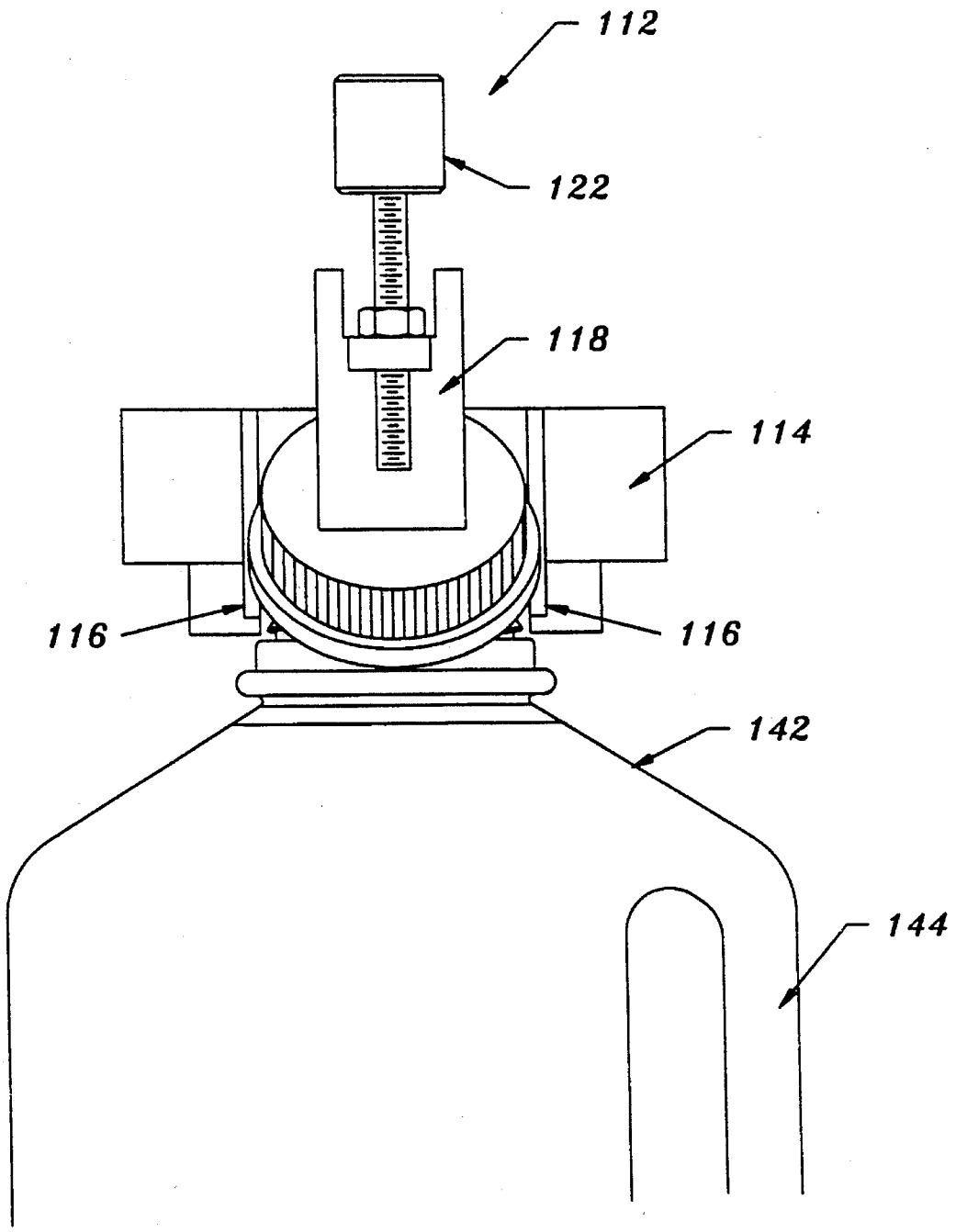
FIG. 14 is a front elevational view of the feeder assembly shown in FIG. 13.

FIGS. 13 and 14 show the feeder assembly 112 of the present invention. The cap guide 114 includes a pair of spaced rails 116. A stop 118 is spaced such that a cap 20 falls to an angle of about 45° with respect to horizontal. The lower end of the stop 118 has a flat beveled surface 120. Extending from the stop 118 is an adjustable counterweight 122. The rails 116 are spaced from each other, as more clearly shown in FIG. 14, and have a single curvature of generally constant radius. By positioning the cap 20 at an angle of approximately 45°, the chances of improper or inaccurate placement of the cap 20 onto the container neck 19 are reduced. As the container 18 moves into contact with the cap 20 (to the left in FIG. 13), the cap 20 pushes on the stop 118, which results in the momentary lifting of the counterweight 122 and the rotation of the stop 118 about the pivot pin 124. As the cap 20 moves out of the position shown in FIG. 13, another cap falls into place and assumes the position of the cap 20 shown in FIG. 13.

FIG. 15 is a sectional view of a cap 20 made in accordance with the present invention. Four discrete threads 133 on the inside surface of the skirt 136 of the cap 20 are equally spaced on the interior of the cap 20. The symmetry of the four-thread configuration further improves and facilitates proper placement of the cap 20 on the container 18, and reduces the likelihood that misalignment will occur. The inside surface of the skirt 136 is tapered such that the lower end 138 of the skirt 136 defines an inside diameter which is greater than the inside diameter defined by the upper end 139 of the skirt 136. In the embodiment shown in FIGS. 15 and 16, the tapering of the inside surface of the skirt 136 is achieved by forming the skirt 136 with thickness which varies from top to bottom, i.e. the skirt wall is thicker at the upper end 139 than at the lower end 138. This configuration results in knurls 134 which are substantially perpendicular to the main disk 135 of the cap 20. Alternatively, the skirt 136 may be formed with a constant thickness, in which case the splines 134 may be at an angle other than 90° with respect to the disk 135. It has been found that forming the inside surface of the skirt 136 with a draft angle A of approximately 2° substantially reduces the incidence of misalignment when placing the cap onto a bottleneck 140.

FIGS. 17 and 18 show a bottleneck configuration in accordance with the present invention. The threads 143 match the threads 133 on the cap 20. In a preferred embodiment, the threads 143 have a buttress configuration. The bottleneck 140 has an upper end 150 which defines an outside diameter which is greater than the outside diameter defined by the lower end 148 of the bottleneck 140. Similarly, the outside diameter of the upper thread tip 145 is less than the outside diameter of the lower thread tip 147. Thus, the overall configuration of the bottleneck 140 including the thread tips 145 and 147 is tapered at an angle B which preferably matches the draft angle A on the inside of the cap 20.

Providing the bottleneck 140 and the cap 20 with matching tapering configurations greatly enhances the trouble-free placement of the caps on the bottlenecks. Bottlers often perform blow-molding of bottles as part of their overall bottling operation. However, it is often difficult for bottlers to blow mold containers of consistent quality. In particular, it is difficult for bottlers to maintain manufacturing tolerances applicable to bottleneck configurations. By providing the cap and bottleneck with tapered configurations, the criticality of the relationship between the container neck and the bottle cap can be reduced without running the risk of misalignment between the cap and container. By making the container neck tapered, the diameter of the uppermost portion of the bottleneck can be made smaller. Similarly, by tapering the skirt of the cap, the diameter of the lower portion of the cap can be made larger. Thus, it is easier to place the cap onto the bottleneck without creating a misalignment of the threads.

While a specific embodiment of the invention has been shown and described, it will be apparent to those skilled in the art that numerous alternatives, modifications, and variations of the embodiment shown can be made without departing from the spirit and scope of the appended claims.

We claim:

1. A capping system comprising a plurality of threaded caps, a plurality of threaded container necks, and a capping apparatus for securing said caps to said necks, said cap requiring no more than about 120° of rotation to be secured to a container neck after being initially positioned adjacent to said container neck, said cap and said neck having both matching thread and matching ratchet configurations, said apparatus comprising:

a feeder for bringing a cap into initial contact with said container neck, a bottle carrier with a plurality of container supports and a plurality of spindles, each of said spindles having a chuck for gripping said cap, said spindles each having a container holder for preventing rotation of said container, a cam for lifting said container support and for lifting said container into engagement with one of said spindles and one of said container holders, a rotation inducing surface, each of said spindles having a pinion for engaging said rotation inducing surface, a pinion carried by each of said spindles for engaging said rotation inducing surface intermittently as a container, cap engaged by one of said spindles, and spindles move said rotation inducing surface.

2. A capping system in accordance with claim 1 wherein:

said apparatus has a central support to which said bottle carrier is mounted.

3. A capping system in accordance with claim 2 wherein:

said rotation inducing surface is non-continuous and is rigidly mounted relative to said bottle carrier.

4. A capping system in accordance with claim 3 wherein:

said rotation inducing surface is releasably mounted to said central support whereby a predetermined lateral force exerted by said pinion on said rotation inducing surface causes said surface to be displaced relative to its original position.

5. A capping system in accordance with claim 4 wherein:

said rotation inducing surface is part of an assembly, and said surface includes a set of gear teeth shaped to mesh with teeth on said pinion, said assembly including a pivoting mechanism, said surface held in place magnetically, and a spring for returning said surface to an original position from a displaced position, said assembly is flexibly mounted to said central support by a resilient rubber bushing.

6. A capping system in accordance with claim 3 wherein:

at least one of said pinion and said rotation inducing surface has gear teeth to engage the other.

7. A capping system in accordance with claim 6 wherein:

both said rotation inducing surface and said pinion have meshing gear teeth.

8. A capping system in accordance with claim 6 wherein:

said rotation inducing surface has a length which causes rotation of said spindle of about 120°.

9. A capping system in accordance with claim 8 wherein:

said rotation inducing surface is positioned above said cam such that when said cap and containers are lifted into engagement with said spindle by said cam, rotative forces are applied to said cap relative to said neck, and said forces stop being applied when said pinion moves out of contact with rotation inducing surface.

10. A capping system in accordance with claim 1 wherein:

said spindle has a grip for holding said cap, said grip being rotationally fixed with respect to said pinion, said grip holding said cap such that rotation of said pinion causes said cap to tighten onto said neck, and when said cap is tight on said neck, said grip slidably engages said cap and prevents stripping of the threaded connection between said cap and said neck.

11. A capping system in accordance with claim 10 wherein:

said cap has vertically oriented outwardly facing splines and said grip is a ring sized to fit over said cap, said ring having radially resilient inwardly directed edges for engaging said splines.

12. A capping system in accordance with claim 9 wherein:

said edges are vertically oriented, each of said edges being shaped to fit into a space between two of said splines on said cap.

13. A capping system in accordance with claim 10 wherein:

edges are the tips of discrete fingers, one of said edges being disposed on a free end of each of said fingers.

14. A capping system in accordance with claim 10 wherein:

said fingers carry metal tips which engage said cap.

15. A capping system in accordance with claim 11 wherein:

said edges are the tips of internally extending ribs which match splines on said cap, and said ribs are formed on segments which are resiliently joined at their ends to form a radially resilient ring.

16. A capping system in accordance with claim 9 wherein:

said ring includes a pair of diametrically opposed spring loaded teeth with internally directed ribs forming said edges, said ribs matching splines on said cap, said spring loaded teeth being pivotable into and out of gripping engagement with said cap.

17. A capping system in accordance with claim 1 wherein:

said cap has a skirt which defines a first inside diameter at its lower edge and a second inside diameter at its upper end, said first diameter being larger than said second diameter.

18. A capping system in accordance with claim 17 wherein:

the thread configuration of said cap is on an inside surface of said skirt of said cap, and said thread configuration of said bottle neck extends from a neck wall, said neck wall having an upper inside diameter less than its lower inside diameter.

19. A capping system in accordance with claim 1 wherein:

said feeder comprises a pair of spaced-apart arcuate ledges for retaining said cap by engaging a rachet ring carried by said cap, said feeder including a pivoting stop for limiting gravitationally induced movement of said caps, said ledges being disposed a distance from said stop such that said caps fall into an angled position about 45° to horizontal prior to being engaged by a container neck.

20. A capping system in accordance with claim 19 wherein:

said stop has an angled surface for contacting an upper surface of said caps, said angled surface being disposed at an angle of about 45° to horizontal, said ledges being spaced from each other and from said stop such that said caps fall into a position whereby an upper surface of said caps about said angled surface of said stop prior to being engaged by a container neck.

21. A capping apparatus for securing a threaded cap to the threaded neck of a container, said apparatus comprising:

a slide for bringing a cap into initial contact with said container neck, a turret carrying a plurality of spindles, a plurality of container supports driven synchronously with said spindles, each of said spindles having a chuck for resiliently gripping said cap, said spindles each having a container holder for preventing rotation of said container, a cam for lifting said container support and for lifting said container into engagement with one of said spindles and one of said container holders, a fixed rotation inducing surface, each of said spindles having a pinion for engaging said rotation inducing surface, said rotation inducing surface extending less than the full circumference of said turret whereby a pinion carried by one of said spindles engages said rotation inducing surface intermittently as said one of said spindles moves with said turret.

22. An apparatus in accordance with claim 21 wherein:

said apparatus has a central support to which said turret is rotatably mounted.

23. An apparatus in accordance with claim 22 wherein:

said rotation inducing surface is arcuate and non-continuous and is fixedly mounted to said central support.

24. An apparatus in accordance with claim 21 wherein:

at least one of said pinion and said rotation inducing surface has gear teeth to engage the other.

25. An apparatus in accordance with claim 21 wherein:

both said rotation inducing surface and said pinion have meshing gear teeth.

26. An apparatus in accordance with claim 21 wherein:

said rotation inducing surface causes rotation of said cap about said container of about 120°.

27. An apparatus in accordance with claim 21 wherein:

said rotation inducing surface is positioned above said cam such that when said cap and containers are lifted into engagement with said spindle by said cam, rotative forces are applied to said cap relative to said neck, and said forces stop being applied when said pinion moves out of contact with rotation inducing surface.

28. An apparatus in accordance with claim 21 wherein:

said rotation inducing surface is arcuate and non-continuous and is fixedly mounted to said central support.

29. An apparatus in accordance with claim 21 wherein:

said cap has vertically oriented outwardly facing splines and said grip includes a ring sized to fit over said cap, said ring having radially resilient inwardly directed extensions of said ring for engaging said splines.

30. An apparatus in accordance with claim 29 wherein:

said extensions are vertically oriented edges, each of said edges being shaped to fit into a space between two of said splines.

31. An apparatus in accordance with claim 29 wherein:

said extensions are discrete fingers, one of said edges being disposed on a free end of each of said fingers.

* * * * *